US011160701B1

(12) United States Patent
Johnson

(10) Patent No.: US 11,160,701 B1
(45) Date of Patent: Nov. 2, 2021

(54) GURNEY COVER AND OPTIONAL HEATING SYSTEM

(71) Applicant: Mary Johnson, Baltimore, MD (US)

(72) Inventor: Mary Johnson, Baltimore, MD (US)

( * ) Notice: Subject to any disclaimer, the term of this patent is extended or adjusted under 35 U.S.C. 154(b) by 244 days.

(21) Appl. No.: 16/437,046

(22) Filed: Jun. 11, 2019

(51) Int. Cl.
*A61G 1/04* (2006.01)
*A61G 1/01* (2006.01)

(52) U.S. Cl.
CPC ..... *A61G 1/04* (2013.01); *A61G 1/01* (2013.01); *A61G 2203/70* (2013.01); *A61G 2210/90* (2013.01)

(58) Field of Classification Search
CPC .. A61G 1/04; A61G 2210/90; A61G 2203/70; A61G 7/1034; A61G 7/1025; A61G 7/1026; A61G 1/01; H05B 1/0272; A61F 7/007
See application file for complete search history.

(56) References Cited

U.S. PATENT DOCUMENTS 4,922,562 A 5/1990 Alfred
5,986,243 A * 11/1999 Campf ..... A41D 13/0051 219/211
6,331,695 B1 12/2001 West
6,969,346 B2 11/2005 Perlatti
7,319,207 B2 1/2008 Campf
8,007,351 B1 8/2011 Maloney
8,387,963 B2 * 3/2013 Moutafis ..... F16B 2/18 269/236
D829,884 S 10/2018 Eker
2006/0071495 A1 * 4/2006 Steigerwald ..... B60R 5/047 296/24.4
2013/0150928 A1 * 6/2013 Walter ..... A61F 7/0097 607/96
2014/0190537 A1 7/2014 Brenda

* cited by examiner

*Primary Examiner* — Eric J Kurilla
(74) *Attorney, Agent, or Firm* — Kyle A. Fletcher, Esq.

(57) ABSTRACT

The gurney cover and optional heating system comprises a container, a body cover spool, a body cover, a head cover spool, a head cover, a plurality of container clips, one or more body cover clips, and one or more head cover clips. The container may couple to a first side of a gurney via the plurality of container clips. The body cover and the head cover may be adapted to be deployed from within the container by pulling them across the gurney to cover a patient. The body cover may couple to a second side of the gurney via one or more body cover clips. The head cover may couple to the second side of the gurney via one or more head cover clips. The body cover, the head cover, or both may comprise battery-powered heating elements that are adapted to warm the patient.

19 Claims, 6 Drawing Sheets

GURNEY COVER AND OPTIONAL HEATING SYSTEM

CROSS REFERENCES TO RELATED APPLICATIONS Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical patient transportation, more specifically, a gurney cover and optional heating system.

SUMMARY OF INVENTION

The gurney cover and optional heating system comprises a container, a body cover spool, a body cover, a head cover spool, a head cover, a plurality of container clips, one or more body cover clips, and one or more head cover clips. The container may couple to a first side of a gurney via the plurality of container clips. The body cover and the head cover may be adapted to be deployed from within the container by pulling them across the gurney to cover a patient. The body cover may couple to a second side of the gurney via one or more body cover clips. The head cover may couple to the second side of the gurney via one or more head cover clips. The body cover, the head cover, or both may comprise battery-powered heating elements that are adapted to warm the patient.

An object of the invention is to couple a container to one side of a gurney using a plurality of container clips.

Another object of the invention is to deploy a body cover and/or a head cover from within the container to the opposite side of the gurney where the body cover is retained by one or more body cover clips and the head cover is retained by one or more head cover clips.

A further object of the invention is to retract the body cover and the head cover into the container using spring-loaded spools when the covers are not in use.

Yet another object of the invention is to provide a battery-operated heating element in the body cover and within the head cover.

These together with additional objects, features and advantages of the gurney cover and optional heating system will be readily apparent to those of ordinary skill in the art upon reading the following detailed description of the presently preferred, but nonetheless illustrative, embodiments when taken in conjunction with the accompanying drawings.

In this respect, before explaining the current embodiments of the gurney cover and optional heating system in detail, it is to be understood that the gurney cover and optional heating system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gurney cover and optional heating system.

It is therefore important that the claims be regarded as including such equivalent construction insofar as they do not depart from the spirit and scope of the gurney cover and optional heating system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
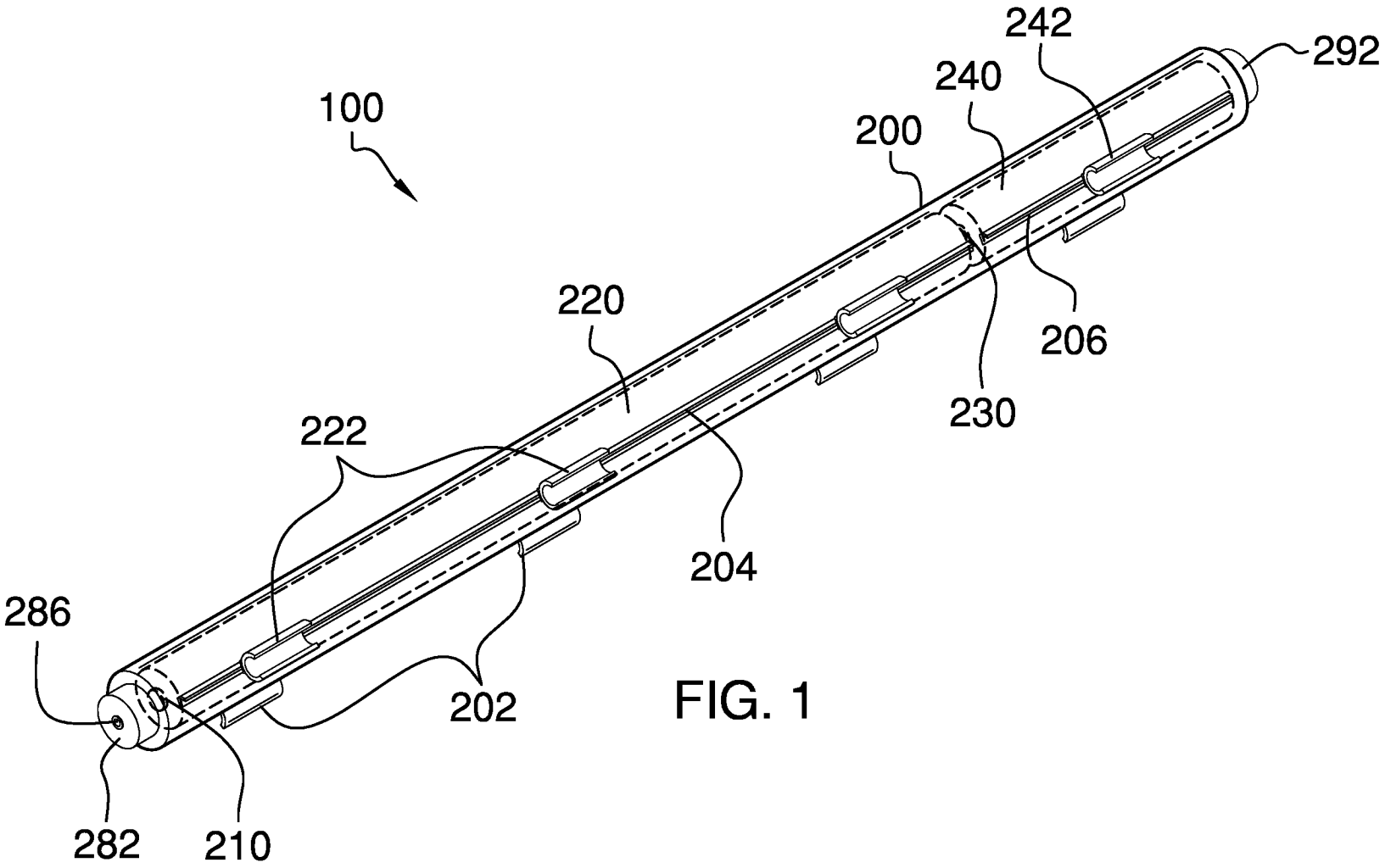
FIG. 1 is a perspective view of an embodiment of the disclosure illustrating the body cover and the head cover retracted into the container.
Figure 2:
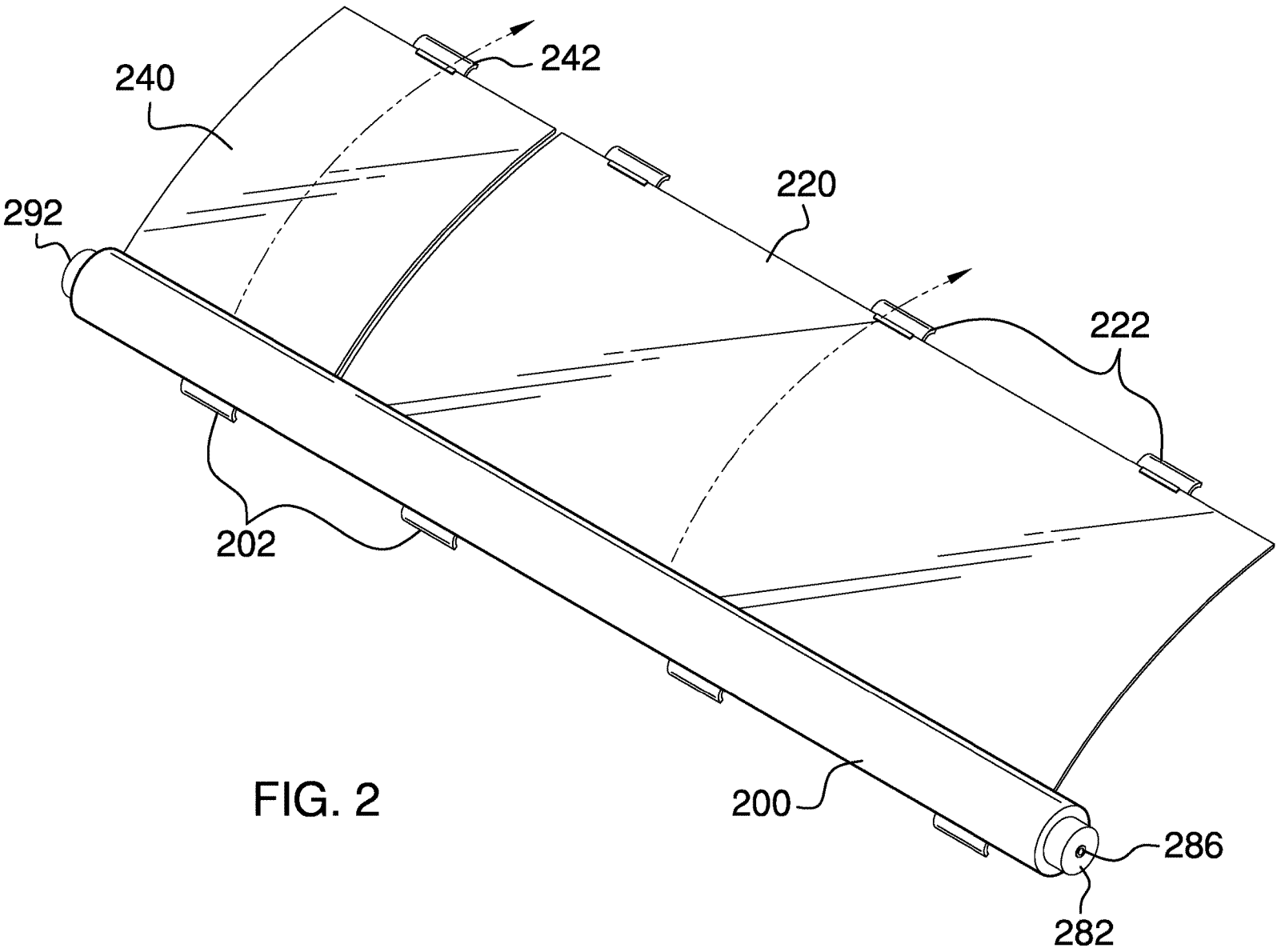
FIG. 2 is a top view of an embodiment of the disclosure illustrating the body cover and the head cover extracted from the container.
Figure 3:
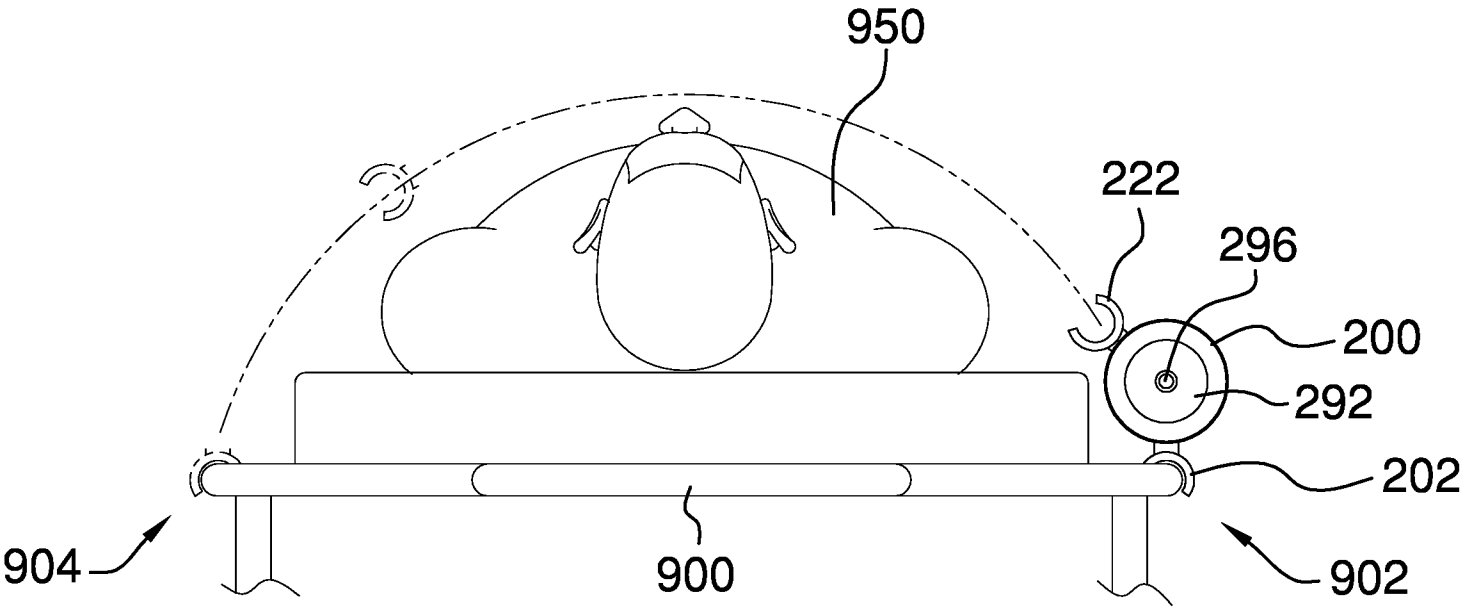
FIG. 3 is a side view of an embodiment of the disclosure.
Figure 4:
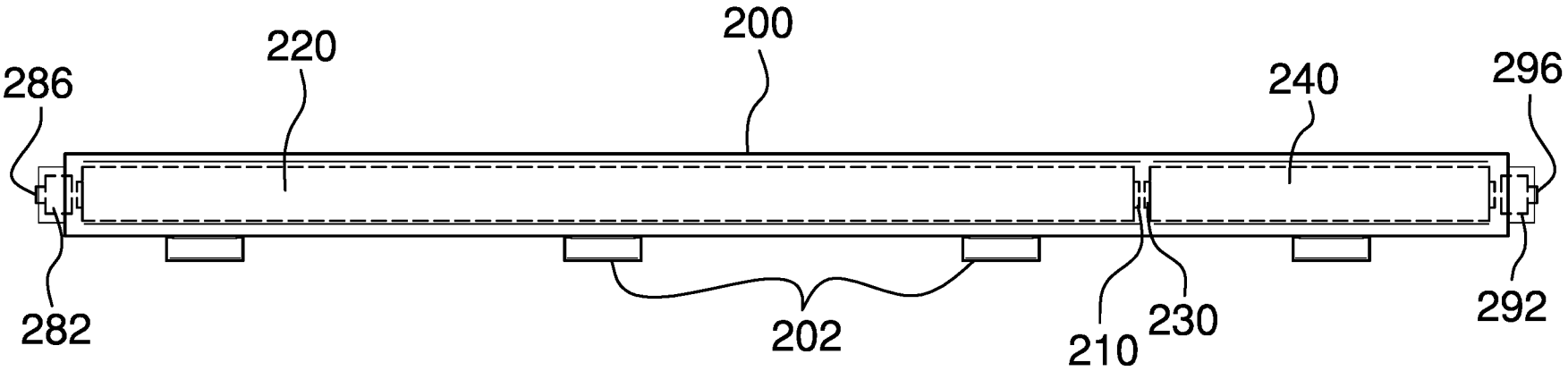
FIG. 4 is a back view of an embodiment of the disclosure.
Figure 5:
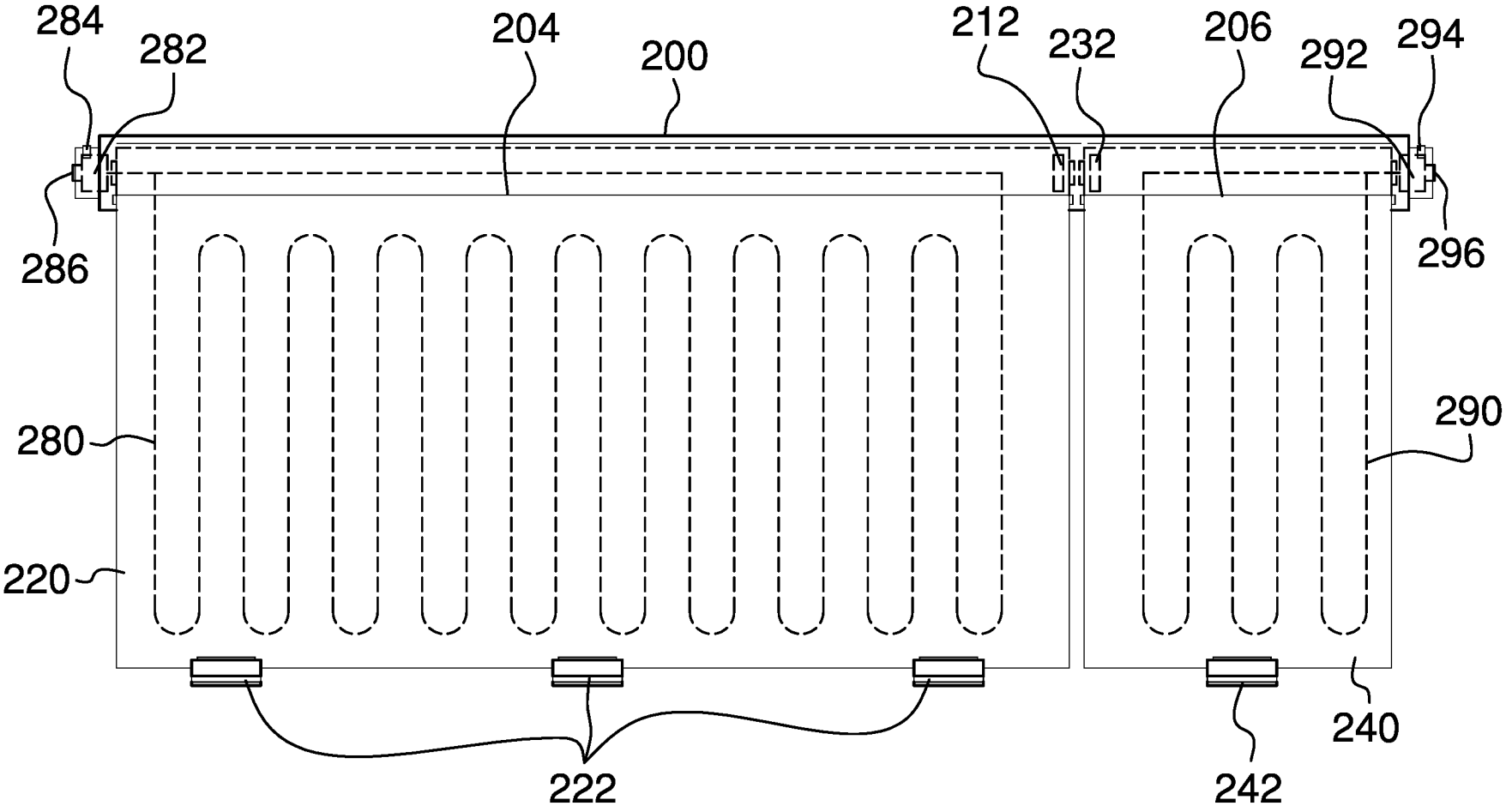
FIG. 5 is a top view of an embodiment of the disclosure.
Figure 6:
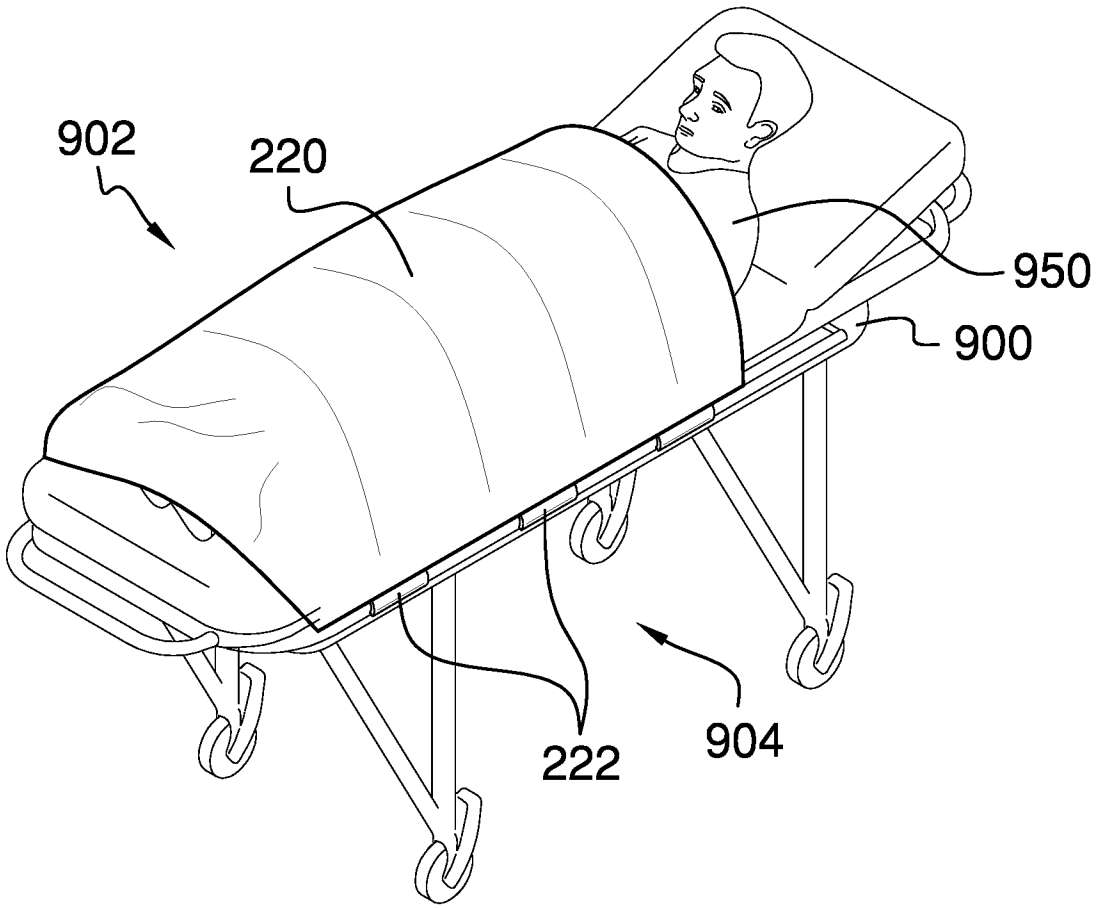
FIG. 6 is an in-use view of an embodiment of the disclosure illustrating the body cover deployed and the head cover retracted.

Detailed reference will now be made to a first potential embodiment of the disclosure, which is illustrated in FIGS. 1 through 6.

The gurney cover and optional heating system 100 (hereinafter invention) comprises a container 200, a body cover spool 210, a body cover 220, a head cover spool 230, a head cover 240, a plurality of container clips 202, one or more body cover clips 222, and one or more head cover clips 242. The container 200 may couple to a first side 902 of a gurney 900 via the plurality of container clips 202. The body cover 220 may be adapted to be deployed from within the container 200 by pulling the body cover 220 across the gurney 900 to cover a patient 950 from the shoulders down. The body cover 220 may couple to a second side 904 of the gurney 900 via the one or more body cover clips 222. The head cover 240 may be adapted to be deployed from within the container 200 by pulling the head cover 240 across the gurney 900 to cover the head of the patient 950. The head cover 240 may couple to the second side 904 of the gurney 900 via the one or more head cover clips 242. The body cover 220, the head cover 240, or both may comprise battery-powered heating elements that are adapted to warm the patient 950.

The container 200 may be a cylindrical tube which encloses the body cover 220 and the head cover 240. The container 200 may comprise a body cover slot 204 and a head cover slot 206 through which the body cover 220 and the head cover 240, respectively, may exit the container 200. The container 200 may be composed of a rigid or semi-rigid material.

The body cover spool 210 may be a spring-loaded cylinder mounted within the container 200. One or more body spool springs 212 may act to rotate the body cover spool 210 in a direction such that the body cover spool 210 pulls the body cover 220 into the container 200 through the body cover slot 204. As the body cover 220 is pulled into the container 200, the body cover 220 may wrap around the body cover spool 210. If an external force is applied to the body cover 220, the external force may pull the body cover 220 out of the container 200 via the body cover slot 204.

The body cover 220 may be adapted to prevent the patient from being exposed to wind, rain, or snow. The body cover 220 may be a rectangular sheet of flexible material. A proximal edge of the body cover 220 may be coupled to the body cover spool 210 such that the body cover 220 may be pulled onto the body cover spool 210 by rotation of the body cover spool 210. A distal edge of the body cover 220 may be coupled to the one or more body cover clips 222. The one or more body cover clips 222 may prevent the distal edge of the body cover 220 from pulling into the container 200. The one or more body cover clips 222 may couple to the second side 904 of the gurney 900 to hold the body cover 220 in place when the body cover 220 is deployed. In some embodiments, the body cover 220 may be water repellent, thermally reflective, or both.

The head cover spool 230 may be a spring-loaded cylinder mounted within the container 200. One or more head spool springs 232 may act to rotate the head cover spool 230 in a direction such that the head cover spool 230 pulls the head cover 240 into the container 200 through the head cover slot 206. As the head cover 240 is pulled into the container 200, the head cover 240 may wrap around the head cover spool 230. If an external force is applied to the head cover 240, the external force may pull the head cover 240 out of the container 200 via the head cover slot 206.

The head cover 240 may be adapted to prevent the patient from being exposed to wind, rain, or snow. The head cover 240 may be a rectangular sheet of flexible material. A proximal edge of the head cover 240 may be coupled to the head cover spool 230 such that the head cover 240 may be pulled onto the head cover spool 230 by rotation of the head cover spool 230. A distal edge of the head cover 240 may be coupled to the one or more head cover clips 242. The one or more head cover clips 242 may prevent the distal edge of the head cover 240 from pulling into the container 200. The one or more head cover clips 242 may couple to the second side 904 of the gurney 900 to hold the head cover 240 in place when the head cover 240 is deployed. In some embodiments, the head cover 240 may be water repellent, thermally reflective, or both.

The plurality of container clips 202, the one or more body cover clips 222, and the one or more head cover clips 242 may be snap-on pipe clips. The plurality of container clips 202 may attach to a rail on the first side 902 of the gurney 900 to retain the container 200 in place on the gurney 900. The one or more body cover clips 222 and/or the one or more head cover clips 242 may attach to a rail on the second side 904 of the gurney 900 to retain the body cover 220 and/or the head cover 240 in place covering the gurney 900. As a non-limiting example, the rails may be hand rails on the sides of the gurney 900.

In some embodiments, the body cover 220 may comprise a body heating element 280. The body heating element 280 may be a resistance wire that is disposed over the area of the body cover 220. As non-limiting examples, the body heating element 280 may be woven into the material of the body cover 220, coupled to the body cover 220 using an adhesive, sandwiched within layers of the body cover 220, or combinations thereof. The body heating element 280 may be electrically coupled to a body heater battery 282 via a body heater ON/OFF control 284. The body heater ON/OFF control 284 may activate the body heating element 280 when the body heater ON/OFF control 284 is in an ON position and may deactivate the body heating element 280 when the body heater ON/OFF control 284 is in an OFF position. As a non-limiting example, the electrical connection between the body cover 220 and the body heater battery 282 may be slip rings and brushes between the body cover spool 210 and the container 200.

The body heater battery 282 may comprise one or more energy-storage devices. The body heater battery 282 may be a source of electrical energy to operate the body heating element 280. The body heater battery 282 may be replaceable or rechargeable. The body heater battery 282 may be rechargeable via a body heater battery plug 286.

In some embodiments, the head cover 240 may comprise a head heating element 290. The head heating element 290 may be a resistance wire that is disposed over the area of the head cover 240. As non-limiting examples, the head heating element 290 may be woven into the material of the head cover 240, coupled to the head cover 240 using an adhesive, sandwiched within layers of the head cover 240, or combinations thereof. The head heating element 290 may be electrically coupled to a head heater battery 292 via a head heater ON/OFF control 294. The head heater ON/OFF control 294 may activate the head heating element 290 when the head heater ON/OFF control 294 is in an ON position and may deactivate the head heating element 290 when the head heater ON/OFF control 294 is in an OFF position. As a non-limiting example, the electrical connection between the head cover 240 and the head heater battery 292 may be slip rings and brushes between the head cover spool 230 and the container 200.

The head heater battery 292 may comprise one or more energy-storage devices. The head heater battery 292 may be a source of electrical energy to operate the head heating element 290. The head heater battery 292 may be replaceable or rechargeable. The head heater battery 292 may be rechargeable via a head heater battery plug 296.

In use, the container 200 is coupled to the first side 902 of the gurney 900 by attaching the plurality of container clips 202 to a rail on the gurney 900. With the patient 950 lying on the gurney 900, the body cover 220 may be deployed from within the container 200 by pulling the distal edge of the body cover 220 such that the body cover 220 extends from the container 200 and unwraps from the body cover spool 210. When the body cover 220 reaches the second side 904 of the gurney 900, the one or more body cover clips 222 may be attached to a rail on the second side 904 of the gurney 900 to retain the body cover 220. The head cover 240 may be deployed from within the container 200 by pulling the distal edge of the head cover 240 such that the head cover 240 extends from the container 200 and unwraps from the head cover spool 230. When the head cover 240 reaches the second side 904 of the gurney 900, the one or more head cover clips 242 may be attached to a rail on the second side 904 of the gurney 900 to retain the head cover 240. To prevent the patient 950 from getting cold, the body heater ON/OFF control 284 may be turned ON to activate the body heating element 280. Additionally, the head heater ON/OFF control 294 may be turned ON to activate the head heating element 290.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder which is defined as a cylinder wherein the curved surface perpendicularly intersects with the two identical flat and parallel ends.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, "flexible" refers to an object or material which will deform when a force is applied to it, which will not return to its original shape when the deforming force is removed, and which may not retain the deformed shape caused by the deforming force.

As used in this disclosure, a "heating element" is a resistive wire that is used to convert electrical energy into heat. As non-limiting examples, common metals used to form heating elements include a combination of nickel and chromium, a combination of iron, chromium and aluminum, a combination of copper, nickel, iron, and manganese, or platinum.

As used in this disclosure, a "patient" is a person who is designated to receive a medical treatment, therapy or service.

The term patient may be extended to an animal when used within the context of the animal receiving veterinary treatment or services As used in this disclosure, a "plug" is an electrical termination that electrically connects a first electrical circuit to a second electrical circuit or a source of electricity.

As used in this disclosure, "resilient" or "semi-rigid" refer to an object or material which will deform when a force is applied to it and which will return to its original shape when the deforming force is removed.

As used herein, "resistance wire" refers to wire intended for use as an electrical resistor. Resistance wire generally has a higher resistivity than other conductors such as copper and aluminum so that a shorter length of wire can be used to construct a higher value resistance. Resistance wire may also be selected for its temperature coefficient of resistivity, oxidation characteristics, solderability, or combination thereof. Resistance wire is often used for heating elements. Non-limiting examples of resistance wire include nichrome wire (a nickel/chromium alloy), iron-chromium-aluminum alloys, constantan (a copper/nickel alloy), and nickel/iron alloys.

As used herein, "rigid" refers to an object or material which is inflexible. If a force is applied to a rigid object the rigid object does not bend or deform unless the force applied reaches the breaking point of the rigid object.

As used in this disclosure, a "slot" is a long narrow groove, cut, opening, or aperture that is formed in or through an object.

As used herein, "snap-on clip" or "snap-on pipe clip" refers to a fastener that comprises a section of a cylinder made from a semi-rigid material with a longitudinal gap of less than half of the cylinder. In some implementations, the edges of the gap may curve outward away from the center of the cylinder. The snap-on clip may be attached to a section of pipe by aligning the clip and the pipe longitudinally with the pipe against the gap and by pressing the clip onto the pipe. As it is pressed onto the pipe, the edges of the clip may spread apart to allow the pipe to pass through the gap. Once the pipe has passed through the gap, the edges may spring back to their original positions such that the clip encircles the pipe and is retained on the pipe. The clip may be removed from the pipe by prying the clip off such that the pipe passes through the gap in the opposite direction.

As used in this disclosure, a "spool" is a cylindrical device upon which a flexible material, including but not limited to a rope, a cable, a yarn, a cord, a sheet of fabric, or a tape, can be wound. Depending on context, a spool may also comprise the flexible material stored upon the spool.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used herein, "water repellent" refers to the hydrophobic characteristic of an object. Water does not easily penetrate a water repellent object. The water repellent characteristic may be intrinsic to the type of material that the object is made of or it may be the result of a coating applied to the object.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A gurney cover and optional heating system comprising:

a container, a body cover spool, a body cover, a head cover spool, a head cover, a plurality of container clips, one or more body cover clips, and one or more head cover clips;

wherein the container couples to a first side of a gurney via the plurality of container clips;

wherein the body cover is adapted to be deployed from within the container by pulling the body cover across the gurney to cover a patient from the shoulders down;

wherein the body cover couples to a second side of the gurney via the one or more body cover clips;

wherein the head cover is adapted to be deployed from within the container by pulling the head cover across the gurney to cover the head of the patient;

wherein the head cover couples to the second side of the gurney via the one or more head cover clips;

wherein the container is a cylindrical tube which encloses the body cover and the head cover;

wherein the container comprises a body cover slot and a head cover slot through which the body cover and the head cover, respectively, exit the container.

2. The gurney cover and optional heating system according to claim 1 wherein the container is composed of a rigid or semi-rigid material.

3. The gurney cover and optional heating system according to claim 2 wherein the body cover spool is a spring-loaded cylinder mounted within the container;

wherein one or more body spool springs act to rotate the body cover spool in a direction such that the body cover spool pulls the body cover into the container through the body cover slot.

4. The gurney cover and optional heating system according to claim 3 wherein as the body cover is pulled into the container, the body cover wraps around the body cover spool;

wherein if an external force is applied to the body cover, the external force pulls the body cover out of the container via the body cover slot.

5. The gurney cover and optional heating system according to claim 4 wherein the body cover is adapted to prevent the patient from being exposed to wind, rain, or snow;

wherein the body cover is a rectangular sheet of flexible material.

6. The gurney cover and optional heating system according to claim 5 wherein a proximal edge of the body cover is coupled to the body cover spool such that the body cover is pulled onto the body cover spool by rotation of the body cover spool.

7. The gurney cover and optional heating system according to claim 6 wherein a distal edge of the body cover is coupled to the one or more body cover clips;

wherein the one or more body cover clips prevent the distal edge of the body cover from pulling into the container;

wherein the one or more body cover clips couple to the second side of the gurney to hold the body cover in place when the body cover is deployed.

8. The gurney cover and optional heating system according to claim 7 wherein the body cover is water repellent, thermally reflective, or both.

9. The gurney cover and optional heating system according to claim 7 wherein the head cover spool is a spring-loaded cylinder mounted within the container;

wherein one or more head spool springs act to rotate the head cover spool in a direction such that the head cover spool pulls the head cover into the container through the head cover slot.

10. The gurney cover and optional heating system according to claim wherein as the head cover is pulled into the container, the head cover wraps around the head cover spool;

wherein if an external force is applied to the head cover, the external force pulls the head cover out of the container via the head cover slot.

11. The gurney cover and optional heating system according to claim 10 wherein the head cover is adapted to prevent the patient from being exposed to wind, rain, or snow;

wherein the head cover is a rectangular sheet of flexible material.

12. The gurney cover and optional heating system according to claim 11 wherein a proximal edge of the head cover is coupled to the head cover spool such that the head cover is pulled onto the head cover spool by rotation of the head cover spool.

13. The gurney cover and optional heating system according to claim 12 wherein a distal edge of the head cover is coupled to the one or more head cover clips;

wherein the one or more head cover clips prevent the distal edge of the head cover from pulling into the container;

wherein the one or more head cover clips couple to the second side of the gurney to hold the head cover in place when the head cover is deployed.

14. The gurney cover and optional heating system according to claim 13 wherein the head cover is water repellent, thermally reflective, or both.

15. The gurney cover and optional heating system according to claim 13 wherein the plurality of container clips, the one or more body cover clips, and the one or more head cover clips are snap-on pipe clips;

wherein the plurality of container clips attach to a rail on the first side of the gurney to retain the container in place on the gurney;

wherein the one or more body cover clips and/or the one or more head cover clips attach to a rail on the second side of the gurney to retain the body cover and/or the head cover in place covering the gurney.

16. The gurney cover and optional heating system according to claim 15 wherein the body cover comprises a body heating element;

wherein the body heating element is a resistance wire that is disposed over the area of the body cover;

wherein the body heating element is electrically coupled to a body heater battery via a body heater ON/OFF control;

wherein the body heater ON/OFF control activates the body heating element when the body heater ON/OFF control is in an ON position and deactivates the body heating element when the body heater ON/OFF control is in an OFF position.

17. The gurney cover and optional heating system according to claim 16 wherein the body heater battery comprises one or more energy-storage devices;

wherein the body heater battery is a source of electrical energy to operate the body heating element;

wherein the body heater battery is replaceable or rechargeable;

wherein the body heater battery is rechargeable via a body heater battery plug.

18. The gurney cover and optional heating system according to claim 17 wherein the head cover comprises a head heating element;

wherein the head heating element is a resistance wire that is disposed over the area of the head cover;

wherein the head heating element is electrically coupled to a head heater battery via a head heater ON/OFF control;

wherein the head heater ON/OFF control activates the head heating element when the head heater ON/OFF control is in an ON position and deactivates the head heating element when the head heater ON/OFF control is in an OFF position.

19. The gurney cover and optional heating system according to claim 18 wherein the head heater battery comprises one or more energy-storage devices;

wherein the head heater battery is a source of electrical energy to operate the head heating element;

wherein the head heater battery is replaceable or rechargeable;

wherein the head heater battery is rechargeable via a head heater battery plug.

* * * * *